US005640657A

United States Patent [19]

Hart et al.

[11] Patent Number: 5,640,657

[45] Date of Patent: Jun. 17, 1997

[54] ELECTRODE WIRE TWISTED LOOP MOUNTING FOR SCAVENGELESS DEVELOPMENT

[75] Inventors: Steven C. Hart; Gerald M. Kryk, both of Webster, N.Y.

[73] Assignee: Xerox Corporation, Stamford, Conn.

[21] Appl. No.: 568,107

[22] Filed: Dec. 6, 1995

[51] Int. Cl.[6] ..... G03G 15/08

[52] U.S. Cl. ..... 399/291; 140/149; 399/266

[58] Field of Search ..... 355/247, 261–263, 355/265; 118/654, 647–651; 140/101, 102.5, 102, 104, 149; 399/266, 291

[56] References Cited

U.S. PATENT DOCUMENTS

| | | | |
|---|---|---|---|
| 2,683,306 | 7/1954 | Brignall | 29/505 |
| 3,010,494 | 11/1961 | Davis | 140/149 |
| 3,331,178 | 7/1967 | Allers | 140/149 X |
| 4,776,159 | 10/1988 | Lu | 140/149 X |
| 4,868,600 | 9/1989 | Hays et al. | 355/259 |
| 4,896,703 | 1/1990 | Testa, Jr. | 140/104 |
| 5,124,749 | 6/1992 | Bares | 355/202 |
| 5,153,647 | 10/1992 | Barker et al. | 355/245 |
| 5,153,648 | 10/1992 | Lioy et al. | 355/247 |
| 5,300,992 | 4/1994 | Wayman et al. | 355/261 |
| 5,338,893 | 8/1994 | Edmunds et al. | 118/647 |

OTHER PUBLICATIONS

Ozasa, Japanese Abstract 07–140754 Jun. 2, 1995.

*Primary Examiner*—Robert Beatty

[57] ABSTRACT

A device for forming two twisted loops on the ends of a wire electrode to be used in scavengeless development. The wire is supported at both ends in a wire twisting apparatus and a specified tension is applied to the free ends of the wire. A crank is turned so that the both ends of the wire rotate at the same time. This causes the free ends of the wire to twist upon the suspended wire portion, two loops being formed at the ends of the wire. The twisted sections are stable and strong enough to maintain the loops when the wire is mounted in the development system.

19 Claims, 4 Drawing Sheets

ELECTRODE WIRE TWISTED LOOP MOUNTING FOR SCAVENGELESS DEVELOPMENT

Related patent applications entitled "Electrode Wire Support for Scavengeless Development" (D/95257), U.S. Ser. No. 08/568,108 "Electrode Wire Positioning for Scavengeless Development" (D/95201), U.S. Ser. No. 08/568,105 and "Electrode Wire Tensioning for Scavengeless Development" (D/95202) U.S. Ser. No. 08/568,106 are being filed on the same date as this patent application.

This invention relates generally to developer apparatus for electrophotographic printing. More specifically, the invention relates to twisting the ends of a wire electrode to form loops for mounting purposes in a scavengeless development system.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development". The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "transport" roll. The transport roll is typically in the form of a cylindrical sleeve rotating around a fixed assembly of permanent magnets. The carrier beads form chains extending from the surface of the transport roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor.

Another known development technique involves a single component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a transport roll. In the development zone adjacent the electrostatic latent image on a photoreceptor, the electrostatic charge on the photoreceptor will cause the toner particles to be pulled from the developer to the photoreceptor. (As used in the claims herein, the phrase "developer material" shall be construed to mean either single-component or two-component developer material, or a portion thereof, such as the toner separated from the two-component developer material on a magnetic brush.)

An important variation to the general principle of development is the concept of "scavengeless" development. The purpose and function of scavengeless development are described more fully in, for example, U.S. Pat. No. 4,868,600. In a scavengeless development system, toner is made available to the photoreceptor by means of AC electric fields supplied by electrode structures, commonly in the form of wires extending across the photoreceptor, positioned within the nip between a donor roll and photoreceptor. The spacing between the wires and the donor roll is on the order of the thickness of the toner or less, under certain operating conditions the wires may be in contact with the donor roll. Because there is no physical contact between the development apparatus and the photoreceptor, scavengeless development is useful for devices in which different types of toner are supplied onto the same photoreceptor, as in "tri-level" or "recharge, expose, and develop" highlight or image-on-image color xerography.

A typical "hybrid" scavengeless development apparatus includes, within a developer housing, a transport roll, a donor roll, and an electrode structure. The transport roll operates in a manner similar to a development roll in a conventional development system, but instead of conveying toner directly to the photoreceptor, conveys toner to a donor roll disposed between the transport roll and the photoreceptor. The transport roll is electrically biased relative to the donor roll, so that the toner particles are attracted from the transport roll to the donor roll. The donor roll further conveys toner particles from the transport roll toward the photoreceptor. In the nip between the donor roll and the photoreceptor are the wires forming the electrode structure. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud, forming a toner powder image thereon.

The following disclosures may be relevant to various aspects of the present invention:

U.S. Pat. No. 4,868,600

Patentee: Hays et al.

Issued: Sep. 19, 1989

U.S. Pat. No. 5,124,749

Patentee: Bares

Issued Jun. 23, 1992

U.S. Pat. No. 5,300,992

Patentee: Wayman et al.

Issued: Apr. 5, 1994

U.S. Pat. No. 5,153,648

Patentee: Lioy et al.

Issued: Oct. 6, 1992

U.S. Pat. No. 5,338,893

Patentee: Edmunds et al.

Issued: Aug. 16, 1994

U.S. Pat. No. 5,153,647

Patentee: Barker et al.

Issued Oct. 6, 1992

U.S. Pat. No. 2,683,306

Inventor: Brignail

Issued: Jul. 13, 1954

U.S. Pat. No. 4,896,703

Inventor: Testa, Jr.

Issued: Jan. 30, 1990

The relevant portions of the foregoing disclosures may be briefly summarized as follows:

U.S. Pat. No. 4,868,600 describes a scavengeless development system in which toner is detached from a donor roll by AC electric fields applied to electrode structures which generate a controlled powder cloud of toner for the development of a latent image. The electrode structure is comprised of one or more thin wires which are placed in close proximity to the toned donor within the gap between the toned donor and the latent image. The wires are spaced from the donor structure by the thickness of the toner on the donor structure. The extremities of the wires are supported by the tops of end blocks on both ends of the donor roll which also support the donor roll for rotation. The wire extremities are attached so that they are slightly below a tangent to the donor with the toner layer surface.

U.S. Pat. No. 5,124,749 teaches a scavengeless development system in which the vibration of the electrode wires is dampened due to a unique wire support structure. The electrode wire is rigidly secured to a support with a wire anchor on one end and the donor roll at the other end. Damping the vibration of the electrode wire is accomplished by coating a portion of the electrode wire with a damping material. The damping material is applied to the wire and support between the anchor and the end of the support adjacent the donor roll.

U.S. Pat. No. 5,300,992 describes a method of supporting wire electrodes in a scavengeless development system. An off-axis wire mounting allows taut wires to make gentler contact with a rotating donor roll without tight tolerance requirements. The wires are made to "float", which means that there is no fixed anchor point for the wires.

U.S. Pat. No. 5,153,648 discloses a scavengeless development system with an electrode wire a support which contacts the wire in at least two points. The first support point is a lateral force pin which exerts a lateral or tangential force on the wire and is located close to the donor roll end. The second support is a horizontally mounted pin which exerts a vertical force on the wire and is placed under the wire at a location beyond that of the lateral force pin in the direction outwardly from the donor roll edge. An anchor point fixes the end of the wire beyond the horizontally mounted pin.

U.S. Pat. No. 5,338,893 teaches a scavengeless development apparatus with an electrode wire disposed between a donor roll and a latent image. The donor roll includes a section of increased diameter spaced away from the latent image and the electrode wire is disposed in sliding contact with the section of increased diameter to obtain a consistent spacing from the main length of the donor roll. A support structure with optional grooves, is located near the increased diameter ring area and supports the wire in the vertical direction after the wire passes over the increased diameter area. An anchor point is located beyond the support structure. A tensioning mechanism is provided so as to urge the electrode wires against the increased diameter area and the support structure.

U.S. Pat. No. 5,153,647 describes two different ways of positioning electrode wires in a development zone adjacent a photoconductive member in a scavengeless development system. One method of mounting the electrode wires is securing the ends of the electrode wires to an adjustable bow frame, which positions the electrode wires relative to the donor roll. The other method of mounting the electrode wires is fixing the wire ends to a rigid frame. One end of the wires is fixedly attached to the from and the other end may be adjustably attached to the frame.

U.S. Pat. No. 2,683,306 teaches a method of forming a leader tie which has of a metal core or wire surrounded by a sheath of plastic material. The leader tie is made by first wrapping one end of the wire around a hook forming a loop between the free end of the wire and the main wire whose end is fixed. As the hook is rotated, a twisted wire section is formed about the main wire. A weight is attached to the free end of the wire so that wire in the twisted portion will cut through the plastic coating until it meets the wire in the main wire. This arrangement insures that the wire wrap is a permanent and compact tie which will not unwrap.

U.S. Pat. No. 4,896,703 discloses a device for twisting a J-shaped wire preform into a hangwire. Both ends of the wire are clamped in place, the loop in the J-shaped portion being attached to a hook. The hook is rotated by a crank to form a twisted section of wire to hold the loop.

All of the above patents are hereby incorporated by reference.

Hybrid scavangeless development utilizes very fine wires located in intimate contact with a rotating donor roll. In normal operation, the wire is electrically excited to cause the formation of a powder cloud in the photoreceptor/development nip. This excitation also attracts the wire to the donor roll. Thus in normal operation, a tensioned wire rides/rubs on a hard toner covered surface. In order for HSD systems to function properly, it is necessary to precisely locate the wires, to prevent the wire from vibrating like a musical instrument string, and to prevent the wire from wearing through at the donor roll ends. Precise control of the wire tension, wire to wire spacing, location of the wire array, and the spatial relationship between the wires and the donor roll ends has been demonstrated to prevent copy quality defects such as edge banding and strobing as well as to prevent wire wear at the donor roll ends and thus ensure maximal wire life.

SUMMARY

In accordance with one aspect of the present invention, there is provided a method of forming support loops on a wire by wrapping a wire around a first wire support and supporting a second end of the wire on a second wire support such that there is a a suspended wire section located between the first wire support and the second wire support,tensioning the wire, rotating the the first wire support so that a loop is formed at the end of the wire, wherein the loop is secured by the wire section twisting upon the suspended wire section and the wire has a diameter which makes the wire suitable to be used as an electrode wire for producing a toner cloud in a developing system.

Pursuant to another aspect of the present invention, there is provided a method of forming support loops on a wire by wrapping a wire around a first wire support and a second wire support such that there is a a suspended wire section located between the first wire support and the second wire support, tensioning the wire, and rotating the wire supports so that loops are formed at the ends of the wire, the loops are secured by the free ends of the wire twisting upon the suspended wire section.

Yet another aspect of the invention is drawn to an apparatus for forming support loops on a wire which is to be supported at both ends. Two wire supports are provided for wrapping the wire around so that there is a suspended wire section, a tensioning mechanism tensions the wire and a rotating mechanism rotates the wire supports so that the wire is twisted upon itself and a loop is formed at each end of the wire.

This invention is drawn to using a very fine wire, approximately 50–100 micron diameter, wire located, under tension, in contact with the donor roll to generate the powder cloud from which the image is developed. To function, the wire must be mounted, brought to tension, and maintained under tension within a given tolerance. By twisting a loop in both ends of the wire, the wire can be mounted over mounting posts at each end, brought into tension, and maintained at the required tension. This approach represents a significant improvement over the clamping, gluing, and/or soldering techniques employed in prior electrode wire mountings. The ease with which the ends of the electrode wires are fixed using this twisted loop end fixing greatly facilitates the fabrication of the wire module assembly.

Other features of the present invention will become apparent as the following description proceeds and upon reference to the drawings, in which.

While the present invention will be described in connection with preferred embodiments thereof, it will be understood that it is not intended to limit the invention to these embodiment. On the contrary, it is intended to cover all alternatives, modifications, and equivalents as may be included within the spirit and scope of the invention as defined by the appended claims.

DETAILED DESCRIPTION

Figure 1:
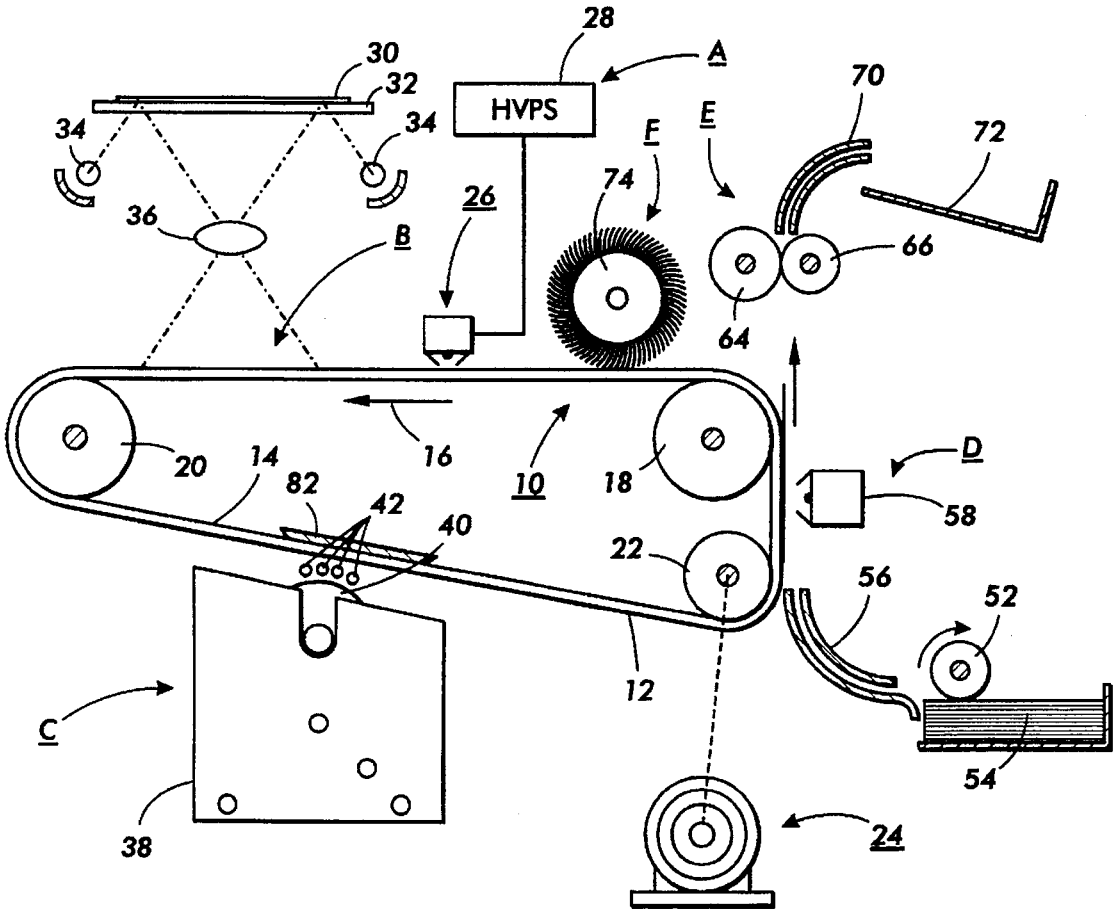
FIG. 1 is an elevational view of an electrophotgraphic printing apparatus in which the present invention may be embodied.

Referring initially to FIG. 1, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14 located on a flexible support member such as a Mylar™ belt. Preferably the surface 12 is made from a selenium alloy. The substrate 14 is preferably made from a conductive metal oxide which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to device 26. After charging, the charged area of surface 12 is passed to exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a development system housed in housing 38 develops the latent image recorded on the photoconductive surface. Preferably, development system includes a donor roller 40 and electrode wires positioned in the gap between the donor roll and photoconductive belt. Electrode wires 42 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor roll 40 is mounted, at least partially, in a chamber of the housing 38, which stores a supply of developer material. The developer material is a two component developer material of at least magnetic carrier granules having toner particles adhering triboelectrically thereto. A transport roller disposed interiorly of the chamber of housing 38 conveys the developer material to the donor roller. The transport roller is electrically biased relative to the donor roller so that the toner particles are attracted from the transport roller to the donor roller.

After the electrostatic latent image has been developed, belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 to the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 2:
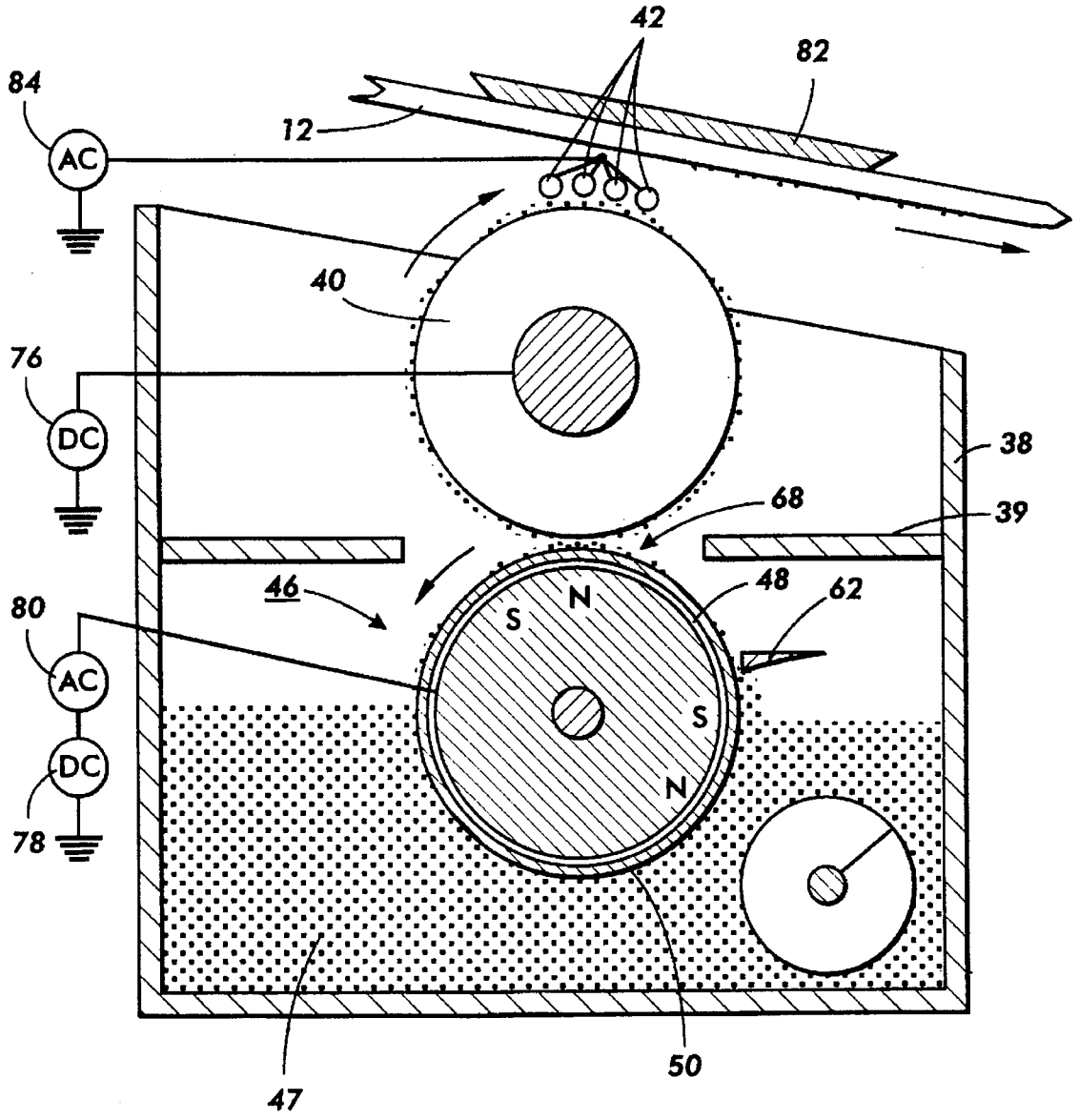
FIG. 2 is a simplified elevational view of a hybrid scavengeless development station.

Referring now to FIG. 2, there is shown a hybrid-scavengeless development system in greater detail. Housing 38 defines a chamber for storing a supply of developer material 47 therein. A housing shelf 39 separates the developer housing into two sections; one associated with the donor roll and the other associated with the transport roll 46. Positioned in the bottom of housing 38 is a horizontal auger which distributes developer material uniformly along the length of transport roll 46, so that the lowermost part of roll 46 is always immersed in a body of developer material.

Transport roll 46 comprises a stationary multi-polar magnet 48 having a closely spaced sleeve 50 of non-magnetic material, preferably aluminum, designed to be rotated about the magnetic core 48 in a direction indicated by the arrow. Because the developer material includes magnetic carrier granules, the effect of the sleeve rotating through stationary magnetic fields is to cause developer material to be attracted to the exterior of the sleeve. A doctor blade 62 is used to limit the radial depth of developer remaining adherent to sleeve 50 as it rotates to the nip 68 between transport roll 46 and donor roll 40. The donor roll is kept at a specific voltage, by a DC power supply 76, to attract a thin layer of toner particles from transport roll 46 in nip 68 to the surface of donor roll 40. Either the whole of the donor roll 40, or at least a peripheral layer thereof, is preferably of material which has low electrical conductivity. The material must be conductive enough to prevent any build-up of electric charge with time, and yet its conductivity must be low enough to form a blocking layer to prevent shorting or arcing of the magnetic brush to the donor roll.

Transport roll 46 is biased by both a DC voltage source 78 and an AC voltage source 80. The effect of the DC electrical field is to enhance the attraction of developer material to sleeve 50. It is believed that the effect of the AC electrical field applied along the transport roll in nip 68 is to loosen the toner particles from their adhesive and triboelectric bonds to the carrier particles. AC voltage source 80 can be applied either to the transport roll as shown in FIG. 2, or directly to the donor roll in series with supply 76.

Electrode wires 42 are disposed in the space between the belt 10 and donor roll 40. Four electrode wires are shown extending in a direction substantially parallel to the longitudinal axis of the donor roll 40. The electrode wires are made from of one or more thin (i.e. 25 to 125 micron diameter) steel, stainless steel or tungsten wires which are closely spaced from donor roll 40. The diameter of the wires shown in the figures is greatly exaggerated compared to the real wires for illustrative purposes. The distance between the wires and the donor roll 40 is approximately the thickness of the toner layer formed on the donor roll 40, or less. The wires are self-spaced from the donor roller by the thickness of the toner on the donor roller. The wire is supported in close proximity to the ends of the donor roll. This support locates the wires such that the wire and donor roll end maintain a specific required angular relationship. An alternating electrical bias is applied to the electrode wires by an AC voltage source 84. The applied AC establishes an alternating electrostatic field between the wires and the donor roller which is effective in detaching toner from the surface of the donor roller and forming a toner cloud about the wires At the region where the photoconductive belt 10 passes closest to donor roll 40, a stationary shoe 82 bears on the inner surface of the belt. The position of the shoe relative to the donor roll establishes the spacing between the donor roll and the belt. The spacing between the donor roll and photoconductive belt is preferably about 0.4 mm.

Another factor which has been found to be of importance is the speed with which the sleeve 50 is rotated relative to the speed of rotation of donor roll 40. In practice both would be driven by the same motor, but a gear train would be included in the drive system so that sleeve 50 is driven at a significantly faster surface velocity than is donor roll 40. A transport roll:donor roll speed ratio of 3:1 has been found to be particularly advantageous, and even higher relative speeds might be used in some embodiments of the invention. In other embodiments the speed ratio may be as low as 2:1.

Figure 3:
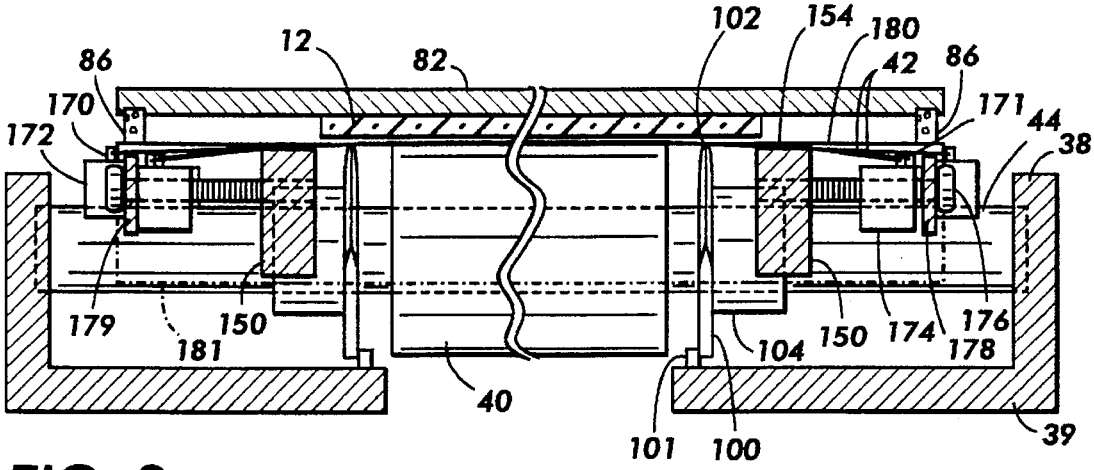
FIG. 3 is a side view of a novel wire module assembly.

FIG. 3 shows a novel wire module for supporting, tensioning and locating the wire electrodes 42 in a hybrid scavengeless development system. The following is a general description of the various components. As shown, there are four wires 42 in the wire module, however there may be fewer or more wires than four in any particular HSD system. For simplicity, only one of the wires and its supports will be referenced and discussed.

Donor roll 40 is supported by donor roll shaft 44. The donor roll shaft is rotatably supported by developer housing 38. A wire support 100, also referred to as an "R" bridge, is located in close proximity to the end of the donor roll and provides a narrow rounded and arc shaped stationary surface 102 for the electrode wire 42 to rest on. Affixed to the side of the R bridge is wire module mount 104 which enables mounting of the wire module to the R bridge and hence properly positions the wire module with respect to the donor roll. R bridge stops 101 are located on the developer housing shelf 39 on both ends of the donor roll so that the R bridge will be correctly positioned with respect to the donor roll ends.

A wire locating member 150, or "theta" bridge, attaches the wire module to the wire module mount 104. Preferably, the side supports of the theta bridge are configured to snap fit over the wire module mount for quick and easy attachment. Alternatively, the wire module may be affixed to the housing/module mounts using screws through the theta bridge. The theta bridge has grooves 154 on its upper surface to maintain the wire to wire spacing when the wires have been properly tensioned and positioned.

At the ends of the donor roll shaft is a wire tensioning system comprised of fixed wire anchor 170 and adjustable wire anchor 171, which are attached respectively to fixed wire anchor block 172 and adjustable wire anchor block 174. An adjustment member 176 is held in place by cross bridge 178 at one end and the theta bridge 150 at the other end. The cross bridges 178 and 179 are fixed to the side beams 180 and 181 so as to provide a rigid rectangular structure for the wire module assembly. The cross bridge 178 and theta bridge 150 on each end of the wire module are stationary with respect to each other. Both have a clearance hole for the adjustment screw 176. The wire anchor block 174 has a threaded interior hole and is mounted onto the adjustment screw 176.

It is important to locate the wires accurately in the photoreceptor to donor roll nip. This can be accomplished by many means. For example, docking pads 86, as shown in FIG. 3 could be attached to the shoe 82, which would rotate the wire module assembly to the correct angular location. Alternatively a slot (not shown) maybe provided in the wire module mount 104 which would mate with a similar projecting feature in the theta bridge 150 so as to provide the correct angular location of the assembly. Thus, the angular location of the wire module could be predetermined and fixed with respect to the donor roll. This would allow the wire module assembly to be snap mounted onto the developer housing and utilized at different predetermined angular locations.

Figure 4:
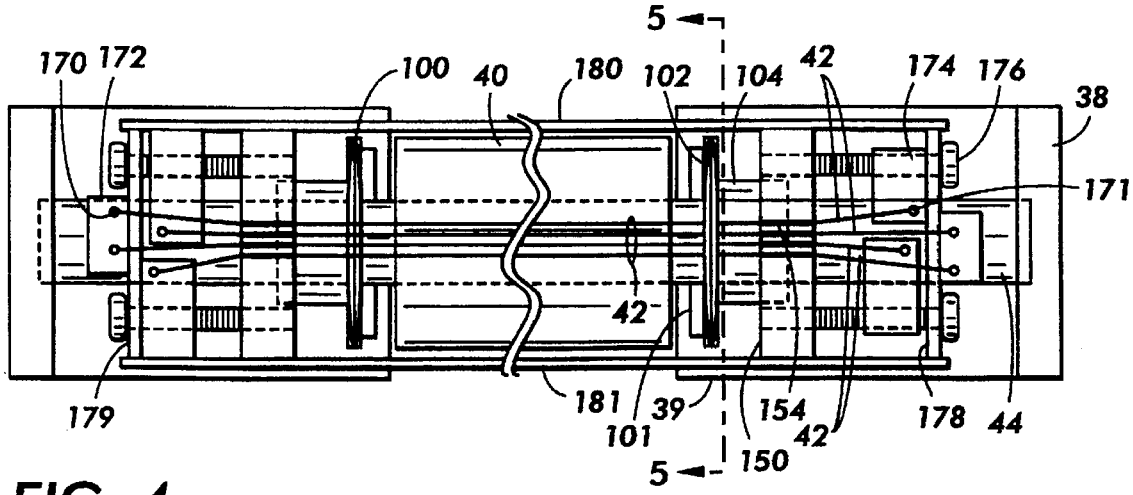
FIG. 4 is a plan view of the novel wire module assembly.

FIG. 4 provides a top view of the wire module, which will be used to discuss the adjustment and placement of the wire module assembly. The R bridge wire locating surface 102 and wire module mount 104 are properly positioned near the end of the donor roll 40 along the donor roll shaft 44. In a separate operation, the wire is attached to wire anchors 170 and 171 and the adjustment member 176 is turned to move the adjustable wire anchor block in such a way that the wire is properly tensioned. As the wire becomes taut, it is securely located in a groove 154 on the theta bridge 150 wire support surface. The entire wire module assembly is then mounted to the developer housing by mounting the theta bridge onto the wire module mount 104.

Figure 5:
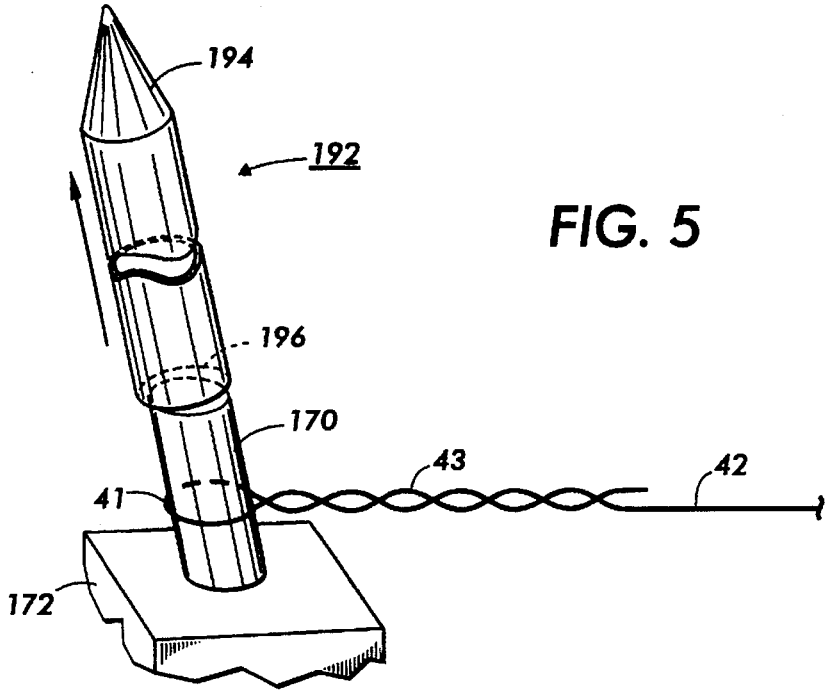
FIG. 5 is an elevational view of a wire mounting post and a wire handler.

FIG. 5 illustrates a single end of the wire loop 41 as it is mounted on a wire anchor pin 170 mounted in anchor block 172. A loop is formed on the end of the wire by bending the free end of the wire back upon itself and then twisting the wire to fix the loop and form a twisted section 43. The loop is then slipped over the wire anchor posts at each end of the wire module and the adjustment member is turned to properly tension the wire.

A wire handler 192 can aid in placing the loop ended wire over anchor pin 170. The wire handler has a pointed end 194 and a hollow open end 196. When positioning the looped portion of the wire onto anchor pin 170, the pointed end 194 is threaded through the wire loop 41and then the hollow end 196 is positioned over anchor pin 170 where the loop is slid from the wire handler onto anchor pin 41.

Figure 6:
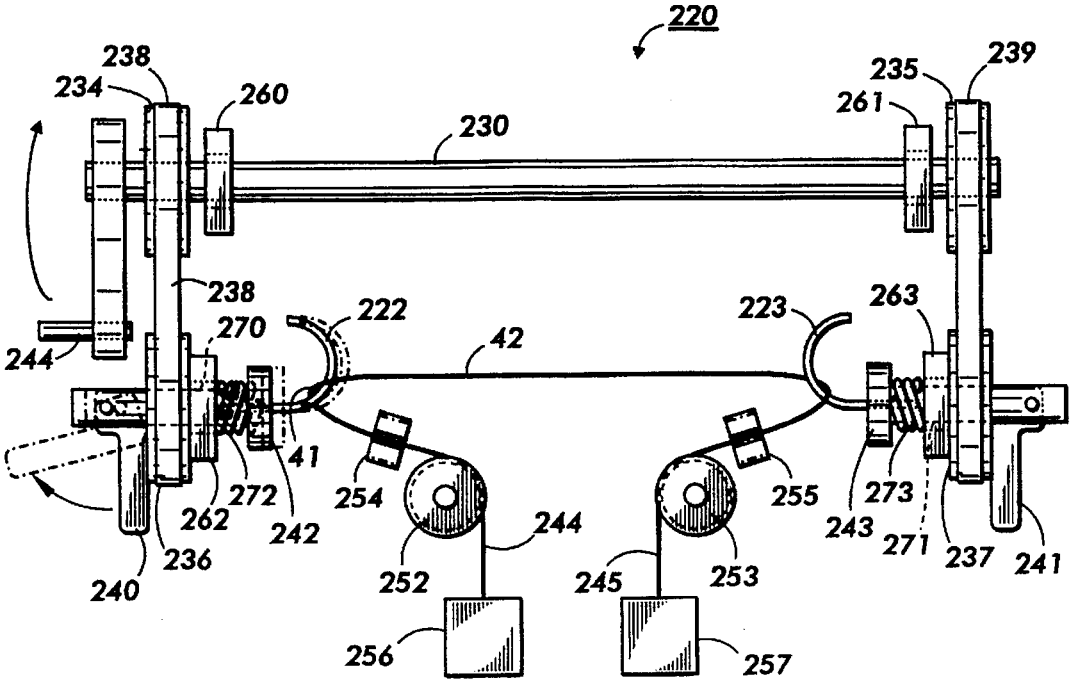
FIG. 6 is a simplified elevational view of a wire twisting mechanism.

It is important that the twisted section of the wire is tightly twisted so that the loop does not unravel or slip when mounted under tension. This can be accomplished be using a wire twisting mechanism which is shown in FIG. 6. The wire is shown mounted to the wire twisting mechanism 220 in the position ready to twist the loops.

There are two support hooks 222 and 223 supported respectively by stand supports 262 and 263. Each hook is adjustably supported in shafts 270 and 271 which connects hook position adjusting members 240 and 241, hook belt pulleys 236 and 237, hook bearings 242 and 243, and springs 272 and 273. Hook position adjusting members 240 and 241 are shown as being levers, however any equivalent adjusting mechanism may be used. The hooks can be translated between a "twisting" and a "loose for wire removal" position. At the start of the twisting operation, the hooks are positioned in the "twisting position. In this position, the distance between the two hooks remains constant, this distance determining the finished loop ended wire length. After the loops are formed at the wire ends, at least one of the hooks is released from the "twisting" position and moved towards the other hook to the "loose for wire removal" position, which removes the tension on the wire created by the twisting operation and makes removing the wire a simple operation.

The hook belt pulleys 236 and 237 are attached to coupling shaft 230 by belts 238 and 239 which wrap around shaft belt pulleys 234 and 235. The coupling shaft 230 is connected to a crank 244 and is rotatably supported by shaft supports 260 and 261. The crank is fixed to the coupling shaft so that when the crank is turned, the coupling shaft will also turn. The coupling shaft turning causes the belts to move, which in turn cause the hooks to rotate.

Clamps 254 and 255 are are useful in positioning the wire in the system. First a weight 256 is attached to a first free end of the wire 244 and positioned over pulley 252. The wire is then clamped in clamp 254 which allows the wire to be positioned over hook 222 without the weight affecting the positioning. Next, the wire is positioned over hook 223 and clamped in place by clamp 255 so that the second free end of the wire 245 can be positioned over the pulley 253 and weight 257 attached. Once weight 257 is attached, the clamps are released and the wire is ready to be twisted.

Pulleys 252 and 253 are configured so that a constant tensile load is applied at a particular angle as the twisted sections are formed. Any other tensioning device which provides a constant tension could also be used in place of the weights and pulleys. It has been found that a 200 g tensile load works well with stainless electrode wire with a 50 micron diameter. The tensile load may be varied depending upon the wire type and size as well as the tension to which it will be subjected in the operative system.

In a preferred embodiment, the crank is turned approximately 10 revolutions. This forms a tightly wound dual helix twist on both ends of the wire which maintains its integrity under tension. If the wire is twisted too many times, the wire breaks and if turned too few times, the twisted section will unravel under tension. At this point, the extra free ends of the wire are cut to remove the weights, the hooks translated towards each other, and the wire is removed from the mechanism. The tensioning mechanism is now ready for a new wire to be mounted. Of course, only one loop may be formed at a time, one of the ends being attached to the rotating hook and the other end being fixed during the twisting operation.

Wires with loops fabricated by this double twisting technique show no indication of slippage under tension. Additionally, the loop does not change the mechanical properties of the wire, the breaking point of the wire still being larger than the original yield point.

It is, therefore, apparent that there has been provided in accordance with the present invention, a scavengeless development wire support system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A method of forming support loops on a wire for use as an electrode wire in a developing system comprising:

wrapping a first end of the wire around a first wire support so that there is a first free end of the wire section;

supporting a second end of the wire on a second wire support such that there is a a suspended wire section located between the first wire support and the second wire support;

tensioning the wire;

rotating the the first wire support so that a first loop is formed at the first end of the wire, wherein the first loop is secured by the first free end of the wire section twisting upon the suspended wire section and the wire has a diameter which makes the wire suitable to be used as an electrode wire for producing a toner cloud in a developing system.

2. A method as claimed in claim 1, wherein, said supporting step further comprises wrapping the second end of the wire around the second wire support such that there is a second wire free end of the wire section; and said rotating step further comprises rotating the the first wire support and the second wire support at the same time so that a second loop is formed at the second end of the wire, wherein the second loop is secured by the second wire free end twisting upon the suspended wire section.

3. A method of forming support ends on a wire for use as an electrode wire in a developing system which is to be supported under tension, comprising:

wrapping a first end of the wire around a first wire support such that there is a first free end of the wire sections and wrapping a second end of the wire around a second wire support such that there is a second free end of the wire section;

tensioning the wire; and rotating the the first and second wire supports at the same time so that a first loop is formed at the first end of the wire, and a second loop is formed at the second end of the wire, wherein the first and second loops are secured by the first and second free end of the wire section twisting upon the suspended wire section, a first twisted wire section being formed at the first end of the wire and a second twisted wire section being formed at the second end of the wire.

4. A method as claimed in claim 3, wherein the distance between the first wire support and the second wire support remains constant during the rotating step.

5. A method as claimed in claim 4, further comprising:

moving the first wire support towards the second wire support after the rotating step to allow the wire to be removed from the first and second wire supports.

6. A method as claimed in claim 2, wherein said wrapping step further comprises attaching a first weight to the first free end of the wire section and a second weight to the second free end of the wire section.

7. A method as claimed in claim 6, wherein said tensioning step comprises having the first and second weights suspended to tension the wire.

8. A method as claimed in claim 7, wherein said wrapping step further comprises passing the first free end of the wire section over a first tensioning support and passing the second free end of the wire section over a second tensioning support so that the first and second weights are properly positioned with respect to the first and second wire supports.

9. A method as claimed in claim 8, wherein the first and second tensioning supports are pulleys.

10. A method as claimed in claim 3, wherein the first and second twisted wire sections are in the form of a dual helix.

11. A method as claimed in claim 3, wherein the wire diameter is between 25–100 microns.

12. A method as claimed in claim 3, wherein the tension in the wire after said rotating step is approximately the tension at which the wire is to be supported under tension.

13. A method as claimed in claim 12, wherein the tension at which the wire is to be supported is approximately 200 g.

14. A method as claimed in claim 12, wherein the first and second loops are adapted to fit over support posts.

15. An apparatus for performing the method of claim 3, wherein weights and pulleys are used in said tensioning step; and a crank and belt assembly are used in said rotating step.

16. An apparatus for forming support ends on a wire which is to be supported at both ends, comprising:

means for wrapping a first end of the wire around a first wire support such that there is a first free end of the wire section and a second end of the wire around a second wire support such that there is a second free end of the wire section;

means for tensioning the wire, the tensioning means including suspending a first weight from the first free end of the wire section and a second weight from the second free end of the wire section; and means for rotating the first and second wire supports at the same time so that a first loop is formed at the first end of the wire, and a second loop is formed at the second end of the wire, wherein the first and second loops are secured by the first and second free end of the wire section twisting upon a suspended wire section, a first twisted wire section being formed at the first end of the wire and a second twisted wire section being formed on at the second end of the wire.

17. An apparatus as claimed in claim 16, wherein the diameter of the wire is approximately 25–100 microns.

18. An apparatus as claimed in claim 16, wherein the distance between the first wire support and the second wire support remains constant during the rotating step.

19. An apparatus as claimed in claim 16, further comprising:

means for handling the wire such that a first end of the handling means is threaded through one of the loops formed in the wire and the second end of the handling means is adapted to fit over a wire mounting post, allowing the loop to slide over the handling means and onto the wire mounting post.

* * * * *